US008967522B2

(12) United States Patent
Ebinuma et al.

(10) Patent No.: US 8,967,522 B2
(45) Date of Patent: Mar. 3, 2015

(54) PAPER SHEET RECEIVING/DISPENSING APPARATUS

(75) Inventors: Ryosuke Ebinuma, Tokyo (JP); Kazuhiro Kagoshima, Tokyo (JP)

(73) Assignee: Fujitsu Frontech Limited, Tokyo (JP)

( * ) Notice: Subject to any disclaimer, the term of this patent is extended or adjusted under 35 U.S.C. 154(b) by 790 days.

(21) Appl. No.: 13/237,492

(22) Filed: Sep. 20, 2011

(65) Prior Publication Data

US 2012/0104015 A1 May 3, 2012

(30) Foreign Application Priority Data

Oct. 29, 2010 (JP) ..... 2010-243149

(51) Int. Cl.

| | |
|---|---|
| ***B65H 39/14*** | (2006.01) |
| ***G07D 11/00*** | (2006.01) |
| ***B65H 29/00*** | (2006.01) |

(52) U.S. Cl.

CPC ..... *G07D 11/0045* (2013.01); *B65H 29/006* (2013.01); *G07D 11/0012* (2013.01); *G07D 11/0084* (2013.01); *B65H 2301/41912* (2013.01); *B65H 2404/282* (2013.01); *B65H 2511/11* (2013.01); *B65H 2511/114* (2013.01); *B65H 2511/142* (2013.01); *B65H 2511/33* (2013.01); *B65H 2511/512* (2013.01); *B65H 2513/10* (2013.01); *B65H 2553/40* (2013.01)

USPC ..... 242/528; 271/216

(58) Field of Classification Search

CPC ..... B65H 29/006; B65H 2301/4191; B65H 2301/41912; B65H 2511/51; B65H 2511/512; B65H 2513/106; B65H 2701/1912; B65H 2220/01; B65H 2220/02

USPC ..... 242/528; 271/3.01, 216

See application file for complete search history.

(56) References Cited

U.S. PATENT DOCUMENTS

| | | | | |
|---|---|---|---|---|
| 6,669,136 | B2 * | 12/2003 | Niioka et al. | 242/528 |
| 7,654,485 | B2 * | 2/2010 | Rossel et al. | 242/528 |
| 8,342,439 | B2 * | 1/2013 | Iwatsuki | 242/528 |
| 8,556,260 | B2 * | 10/2013 | Stemmle | 271/3.15 |
| 2002/0113160 | A1 | 8/2002 | Niioka et al. | |
| 2007/0221776 | A1 * | 9/2007 | Rossel et al. | 242/528 |

FOREIGN PATENT DOCUMENTS

| | | |
|---|---|---|
| JP | 09-174856 | 7/1997 |
| JP | 10-181972 | 7/1998 |
| JP | 2001-341709 | 12/2001 |
| JP | 2002-187662 | 7/2002 |

(Continued)

*Primary Examiner* — William A Rivera

(74) *Attorney, Agent, or Firm* — Greer Burns & Crain Ltd.

(57) ABSTRACT

A paper sheet receiving/dispensing apparatus includes strip films at least one of which is affixed, on at least one of front and back sides, with marks at intervals of a predetermined pattern in a predetermined shape and in a color different from a color of the strip films, a detection sensor for detecting the marks, and a storage device for storing a table that indicates an association between a roll outer diameter of the strip films wound around a winding drum and driving pulses of a stepping motor. The apparatus calculates the roll outer diameter based on the number of rotations of the winding drum, which is calculated based on detection pulses of the marks, and thicknesses of the strip films and a paper sheet, and controls rotations of the motor with driving pulses read from the table.

4 Claims, 11 Drawing Sheets

(56) References Cited

FOREIGN PATENT DOCUMENTS

| | | |
|---|---|---|
| JP | 2004-069933 | 3/2004 |
| JP | 3534966 | 3/2004 |
| JP | 3760375 | 1/2006 |
| JP | 2010-095340 | 4/2010 |

* cited by examiner 32 33 34 31

| | PULSE CYCLE (μs) | NUMBER OF PULSES PER SECOND (pps) | PULSE INDEX (EXAMPLE) |
|---|---|---|---|
| 0 | 30000 | -- | |
| 1 | 5000 | 200 | |
| 2 | 2706 | 370 | |
| 3 | 2392 | 418 | |
| 4 | 2078 | 481 | |
| 5 | 1995 | 501 | |
| 6 | 1912 | 523 | |
| 7 | 1829 | 547 | |
| 8 | 1746 | 573 | |
| 9 | 1662 | 602 | 1 |
| 10 | 1581 | 633 | 2 |
| 11 | 1498 | 668 | 3 |
| 12 | 1414 | 707 | 4 |
| 13 | 1331 | 751 | 5 |
| 14 | 1248 | 801 | 6 |
| 15 | 1165 | 858 | 7 |
| 16 | 1082 | 924 | 8 |
| 17 | 998 | 1002 | 9 |
| 18 | 954 | 1048 | |
| 19 | 917 | 1091 | 10 |
| 20 | 886 | 1129 | |
| 21 | 858 | 1166 | |
| 22 | 834 | 1199 | 11 |

FIG. 3

40

41 43 44 42

| PULSE TABLE | 1 | 2 | 3 | 4 | 5 | 6 | 7 | 8 | 9 | 10 | 11 | PRINT PITCH (mm) | WINDING DIAMETER (mm) | PULSE INDEX |
|---|---|---|---|---|---|---|---|---|---|---|---|---|---|---|
| PULSE AVERAGE TIME (ms) | 1a | 2a | 3a | 4a | 5a | 6a | 7a | 8a | 9a | 10a | 11a | 3 | TAPE START | 11 |
| | 1b | 2b | 3b | 4b | 5b | 6b | 7b | 8b | 9b | 10b | 11b | 6 | WINDING DIAMETER** | 10 |
| | 1c | 2c | 3c | 4c | 5c | 6c | 7c | 8c | 9c | 10c | 11c | 9 | WINDING DIAMETER** | 9 |
| | 1d | 2d | 3d | 4d | 5d | 6d | 7d | 8d | 9d | 10d | 11d | 12 | WINDING DIAMETER** | 8 |
| | 1e | 2e | 3e | 4e | 5e | 6e | 7e | 8e | 9e | 10e | 11e | 15 | WINDING DIAMETER** | 7 |
| | 1f | 2f | 3f | 4f | 5f | 6f | 7f | 8f | 9f | 10f | 11f | 18 | WINDING DIAMETER** | 6 |
| | 1g | 2g | 3g | 4g | 5g | 6g | 7g | 8g | 9g | 10g | 11g | 21 | WINDING DIAMETER** | 5 |
| | 1h | 2h | 3h | 4h | 5h | 6h | 7h | 8h | 9h | 10h | 11h | 24 | | 4 |
| | 1i | 2i | 3i | 4i | 5i | 6i | 7i | 8i | 9i | 10i | 11i | 27 | | 3 |
| | 1j | 2j | 3j | 4j | 5j | 6j | 7j | 8j | 9j | 10j | 11j | 30 | | 2 |
| | 1k | 2k | 3k | 4k | 5k | 6k | 7k | 8k | 9k | 10k | 11k | 33 | WINDING END | 1 |

FIG. 5

PAPER SHEET RECEIVING/DISPENSING APPARATUS

CROSS REFERENCE TO RELATED APPLICATION

This application is based upon and claims the benefit of priority from prior Japanese Application No. 2010-243149, filed Oct. 29, 2010, the entire contents of which are incorporated herein by reference.

BACKGROUND OF THE INVENTION

1. Field of the Invention

The present invention relates to a paper sheet receiving/dispensing apparatus, and more particularly, to a paper sheet receiving/dispensing apparatus, provided with strip films for receiving or dispensing a paper sheet, for controlling a running velocity of the strip films to be stably constant with high precision.

2. Description of the Related Art

Conventionally, there are bill receiving/dispensing apparatuses of a bill recycling unit (hereinafter abbreviated to BRU) that is included, for example, in an ATM (Automated Telling Machine) or the like used in a financial institution or the like. Also a ticketing machine installed in a station yard or the like includes a paper sheet receiving/dispensing apparatus.

Such units include a paper sheet receiving/dispensing apparatus of a strip film type for receiving and dispensing a bill or a ticket (hereinafter referred to as a paper sheet).

This paper sheet receiving/dispensing apparatus is sometimes used as an apparatus dedicated to receipt and dispensing of a paper sheet, dedicated to receipt of a paper sheet, or dedicated to dispensing of a paper sheet.

Structures of such apparatuses dedicated to receipt and dispensing of a paper sheet, dedicated to receipt of a paper sheet, and dedicated to dispensing of a paper sheet are almost identical. Therefore, these apparatus are described below uniformly as a paper sheet receiving/dispensing apparatus.

This paper sheet receiving/dispensing apparatus has advantages that paper sheets can be received and dispensed at low cost without providing a complicated mechanism, many paper sheets can be wound and dispensed with a small capacity, and many types of bills can be received and dispensed only by additionally providing an individual paper sheet receiving/dispensing apparatus.

When receiving a paper sheet, this paper sheet receiving/dispensing apparatus sandwiches the paper sheet between two strip films, and receives the paper sheet by winding the sandwiched paper sheet around a winding drum along with the two strip films.

Additionally, when dispensing a paper sheet, the paper sheet receiving/dispensing apparatus dispenses the paper sheet by rewinding the two strip films wound around the winding drum along with the paper sheet.

Incidentally, in the structure of such a paper sheet receiving/dispensing apparatus, a drum diameter of the winding drum (not the diameter of the drum itself but an outer diameter of the strip films that sandwich a paper sheet and are wound. The same applies hereinafter) increases as the strip films and the paper sheet are being wound around the drum when receiving the paper sheet.

Inversely, when dispensing a paper sheet, the drum diameter decreases as the strip films and the paper sheet are being dispensed.

It is preferable to normally make the receiving velocity and the dispensing velocity of a paper sheet constant in paper sheet receiving/dispensing apparatuses without being limited to the strip film type.

If the receiving velocity or the dispensing velocity of a paper sheet increases or decreases, a velocity difference occurs in a passing part between the paper sheet receiving/dispensing apparatus and a paper sheet conveyance path of a parent machine provided with the paper sheet receiving/dispensing apparatus.

If the velocity difference occurs in the passing part as described above, a paper sheet is stretched or loosened by the passing part.

Such tension changes of a paper sheet in the passing part lead to a paper sheet jam. To prevent the paper sheet jam, the receiving velocity and the dispensing velocity of a paper sheet need to be kept constant.

In the meantime, if an angular velocity of a drum is made constant in the paper sheet receiving/dispensing apparatus of the strip film type, a surface linear velocity of a drum diameter, namely, the running velocity of strip films is fast when the drum diameter is large. Therefore, the receiving or dispensing velocity of a paper sheet becomes fast.

Inversely, if the drum diameter is small, the surface linear velocity, namely, the running velocity of the strip films is slow. Therefore, the receiving or dispensing velocity of a paper sheet becomes slow.

If the receiving velocity or the dispensing velocity of a paper sheet increases or decreases, a problem such as a paper sheet jam occurs in the passing part as described above.

To prevent this problem, it is necessary to control the surface linear velocity of a drum diameter to be constant regardless of whether the drum diameter is either large or small.

To control the surface linear velocity of the drum diameter to be constant, the drum diameter being operated needs to be detected.

For the detection of a drum diameter, for example, Japanese Laid-open Patent Publication No. HEI10-181972 proposes a tape velocity control device for calculating the running velocity of a tape (equivalent to the above described strip film) on a winding drum from an obtained drum diameter and the angular velocity of the winding drum after calculating the drum diameter from the number of rotations of the winding drum, or after calculating the drum diameter from the number of received paper bills.

For the above described detection of the number of rotations of the winding drum, an encoder sensor is provided on a shaft of a motor that drives the running of tapes and rotations of the winding drum via a timing belt, and the number of rotations of the motor is obtained from the number of pulses of a pulse signal output from the encoder sensor.

Then, the number of rotations of the winding drum is obtained from the number of rotations of the motor, and the drum diameter is calculated from the number of rotations of the winding drum, so that the running velocity of the tape on the winding drum is detected from the calculated drum diameter.

However, if the running velocity of the tape suddenly changes such as at the winding or dispensing start of the tape, a slide occurs between the tape and a pulley.

Also if impurities such as dust, paper dust or the like adhere to the timing belt or the pulley while the device is being operated, a slide similarly occurs between the timing belt and the pulley.

Additionally, a relative change occurs in a driving force between the tape and the pulley depending on an environmental condition such as a temperature, humidity or the like at an installation site of the device.

If the slide or the relative change of a driving force occurs between the tape and the pulley as described above, the pulse signal output from the encoder sensor becomes inaccurate.

If the number of rotations of the motor, the drum diameter and the running velocity of the tape are calculated based on the inaccurate pulse signal and the rotational velocity of the motor is controlled based on the calculations, a desired rotational velocity of the motor cannot be achieved.

If the desired rotational velocity of the motor cannot be achieved, the receiving velocity or the dispensing velocity of a paper sheet cannot be kept at a predetermined constant velocity.

In such a case, the problem such as a paper sheet jam or the like is caused by the stretch or the looseness of a paper sheet as described above.

Additionally, if the tape and the pulley are engaged more tightly in order to prevent the slide between the tape and the pulley, a frictional force or a load imposed on both of the members increases, leading to shortening of lifetime of the tape such as an early-stage cut of the tape due to its wear-out and the like as well as shortening of the lifetime of both of the members.

SUMMARY OF THE INVENTION

The present invention overcomes the above described conventional problems, and an object thereof is to provide a paper sheet receiving/dispensing apparatus of a strip film type, which can control the running velocity of strip films with a simple configuration and with high precision in order to stably receive and dispense a paper sheet.

To overcome the above described problems, the paper sheet receiving/dispensing apparatus according to the present invention is a paper sheet receiving/dispensing apparatus of a strip film type for receiving a paper sheet by sandwiching the paper sheet between two strip films respectively held by two holding rollers, and by winding the paper sheet around a winding drum along with the strip films, and for dispensing the paper sheet by rewinding the strip films wound around the winding drum. The apparatus includes: a stepping motor for driving rotations of the holding rollers and the winding drum in forward and backward directions; the strip films at least one of which is affixed, on at least one of front and back sides, with marks at intervals of a predetermined pattern in a predetermined shape and in a color different from a color of the strip films; a detection sensor for detecting the marks; a storage device for storing a stepping motor/slewing table that indicates an association between an index corresponding to a roll outer diameter of the strip films wound around the winding drum and the number of driving pulses or a pulse cycle of the stepping motor, which is specified by the index; and a controlling unit. In the apparatus, the controlling unit includes: pulse signal obtaining means for obtaining a pulse signal indicating that the marks have been detected by the detection sensor during running of the strip films; drum rotation number calculating means for calculating the number of rotations of the winding drum based on the number of pulses of the pulse signal obtained by the pulse signal obtaining means; roll outer diameter calculating means for calculating the roll outer diameter based on the number of rotations of the winding drum, which is calculated by the drum rotation number calculating means, and thicknesses of the strip films and the paper sheet, which are obtained in advance; driving pulse setting means for setting the number of driving pulses for the stepping motor based on the roll outer diameter calculated by the roll outer diameter calculating means, and the stepping motor/slewing table stored in the storage device; and velocity controlling means for controlling a running velocity of the strip films to be a predetermined constant velocity by applying, to the stepping motor, the number of driving pulses set by the driving pulse setting means.

With the paper sheet receiving/dispensing apparatus according to the present invention, the velocity of tapes can be stably controlled without being affected by the conventional problems such as a change of a driving force caused by a sudden velocity change, and a slide between members due to attachment of impurities such as dust, paper dust or the like to the members being operated.

BRIEF DESCRIPTION OF THE DRAWINGS

FIG. 3 illustrates a stepping motor slewing table for controlling driving of a stepping motor in order to keep the running velocity of a tape of the circulation stacker constant;

FIG. 5 illustrates a pulse table for deciding a driving pulse of the stepping motor in order to control the running velocity of the tape to be constant based on the unequal interval marks of the circulation stacker according to the first embodiment;

DESCRIPTION OF THE PREFERRED EMBODIMENTS

Embodiments according to the present invention are described in detail below.

First Embodiment

Figure 1:
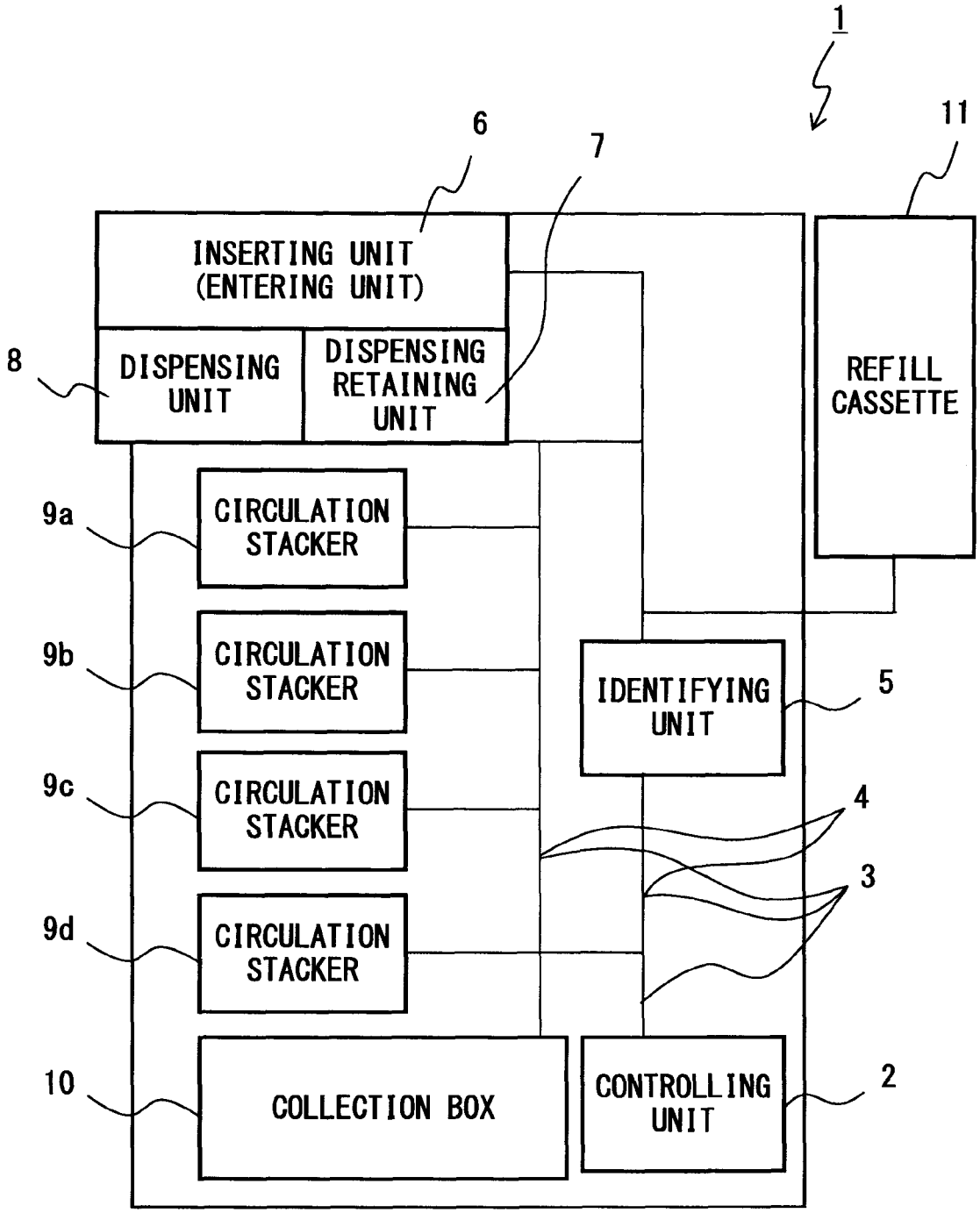
FIG. 1 is a block diagram illustrating a configuration of a BRU (Bill Recycling Unit) that is dedicated to bills and provided with a plurality of paper sheet receiving/dispensing apparatuses according to a first embodiment of the present invention.

FIG. 1 is a block diagram illustrating a configuration of a BRU (Bill Recycling Unit) that is dedicated to bills and provided with a plurality of paper sheet receiving/dispensing apparatuses according to a first embodiment.

As illustrated in FIG. 1, the BRU 1 includes a controlling unit 2, an identifying unit 5, an inserting unit 6, a dispensing retaining unit 7, a dispensing unit 8, four circulation stackers 9 (9*a*, 9*b*, 9*c*, 9*d*) and a collection box 10, which are connected to the controlling unit 2 via a system bus 3 and a conveyance path 4. The BRU 1 externally has an attachable/detachable refill cassette 11.

The inserting unit 6 is an entering unit, in which a customer enters a bill. The dispensing retaining unit 7 is a place for temporarily receiving bills to be dispensed until all of them are prepared.

The dispensing unit 8 is a place to collectively dispense bills prepared in the dispensing retaining unit 7. The circulation stackers 9 are apparatuses included within the BRU (Bill Recycling Unit) 1 as paper sheet receiving/dispensing apparatuses according to the present invention.

Additionally, the circulation stacker 9*a* is an apparatus for receiving, for example, a one-thousand-yen bill and for dispensing the received one-thousand-yen bill. The circulation stacker 9*b* is an apparatus for receiving, for example, a five-thousand-yen bill and for dispensing the received five-thousand-yen bill.

The circulation stacker 9*c* is an apparatus for receiving a ten-thousand-yen bill and for dispensing the received ten-thousand-yen bill. Also the circulation stacker 9*d* is an apparatus similar to that for a ten-thousand-yen bill.

The refill cassette 11 is a cassette device for refilling the circulation stackers 9 with bills if bills within the circulation stackers 9 become insufficient because bills are successively dispensed.

The collection box 10 is a collecting device, configured to be attachable/detachable, for receiving bills dispensed from any of the circulation stackers 9 when a maintenance person collects bills from the BRU (Bill Recycling Unit) 1.

The identifying unit 5 identifies whether a bill that passes through the conveyance path 4 from the inserting unit 6 at the time of bill entry and is collected in any of the circulation stackers 9 is either real or fake, and also identifies the type of the bill.

The identifying unit 5 also identifies the types and the number of bills that pass through the conveyance path 4 from any of the circulation stackers 9 when being dispensed and are conveyed to the dispensing retaining unit 7.

Furthermore, the identifying unit 5 identifies the types and the number of bills that pass through the conveyance path 4 from the refill cassette 11 when being refilled, and are received in any of the circulation stackers 9.

The controlling unit 2 includes a ROM (Read Only Memory), a RAM (Random Access Memory), a cache memory and the like although they are not particularly illustrated.

The controlling unit 2 controls operations of the above described components according to a control program read from the ROM while temporarily holding data being processed in the RAM, the cache memory or the like.

Figure 2:
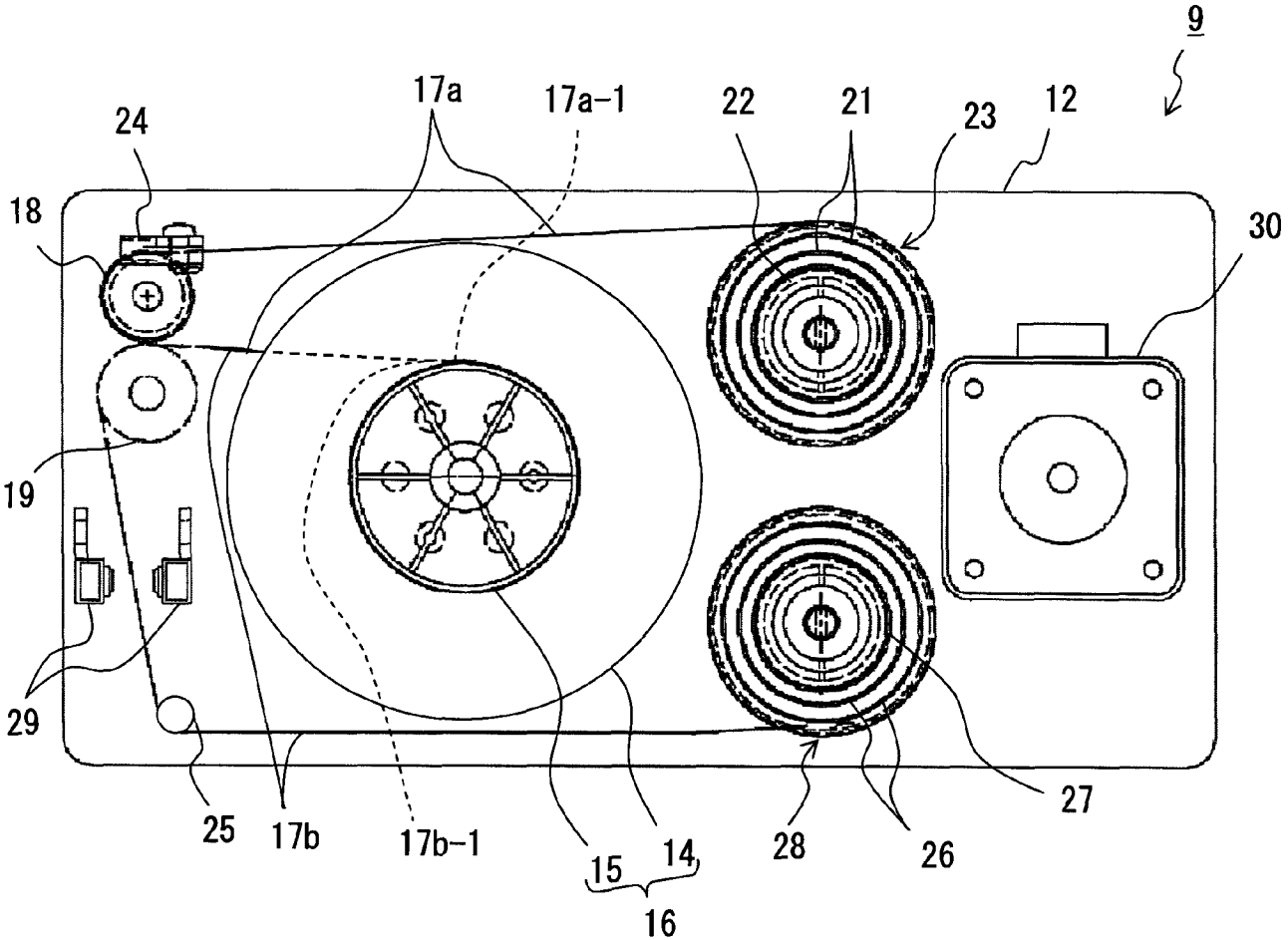
FIG. 2 is a cross-sectional view illustrating a configuration of a plurality of circulation stackers provided in the paper sheet receiving/dispensing apparatus according to the first embodiment.

FIG. 2 is a cross-sectional view illustrating a configuration of the above described circulation stackers 9. Internal configurations of the four circulation stackers 9 are identical although they receive or dispense different types of bills.

As illustrated in FIG. 2, for the circulation stackers 9, a housing 12 includes a winding drum 16 composed of a winding shaft 15 provided with a manual knob 14.

The winding drum 16 winds and rewinds (dispenses) a bill along with two strip films as will be described later. However, the winding drum 16 is referred to as a winding drum here for the sake of convenience.

To the winding shaft 15 of the winding drum 16, starts 17 (17*a*-1, 17*b*-1) of the two strip films (hereinafter referred to as tapes) are respectively fixed.

The two tapes 17 are extended on a tension roller 18 and a rotation conveyance roller 19, held between them, wound around the winding drum 16, or rewound from the winding drum 16.

An end of the tape 17*a* extended on the tension roller 18 is held by a tape holding roller unit 23 provided with a torsion spring 21 and a torque limiter 22, and rewound from the tape holding roller unit 23 or wound around the tape holding roller unit 23.

A bill passage detection sensor 24 for detecting the passage of a bill as a medium is arranged in the neighborhood of the tension roller 18 and the tape 17*a*.

Additionally, the tape 17*b* extended on the rotation conveyance roller 19 is configured to run around the outside of a guide roller 25 arranged below the rotation conveyance roller 19 in the neighborhood of the bottom of the housing 12.

Additionally, an end of the tape 17*b* is held by a tape holding roller unit 28 having a torsion spring 26 and a torque limiter 27, and rewound from or wound around the tape holding roller unit 28.

A tape sensor 29 as a timing sensor for detecting the running velocity of the tape 17*b* and double as an end detection sensor for detecting the end of the tape is arranged between the rotation conveyance roller 19 and the guide roller 25.

The tape sensor 29 is arranged to detect marks affixed on at least one of front and back sides of the tape 17*b*.

The marks include timing marks and an end mark, and they will be described in detail later. The timing marks include unequal interval marks and equal interval marks.

These marks are printed in a color different from that of the tape. For example, the tape is transparent or translucent, whereas the marks are black or the like.

Additionally, a stepping motor 30 is provided in the neighborhood of the tape holding roller unit 23 and the tape holding roller unit 28 on the side opposite to the winding drum 16.

The stepping motor 30 drives the winding drum 16, the tape holding roller unit 23, the tape holding roller unit 28 and the rotation conveyance roller 19 in forward and backward directions via a gear system, not illustrated, under the control of the controlling unit 2.

FIG. 3 illustrates a stepping motor slewing table for controlling the driving of the stepping motor 30 in order to keep the running velocity of the tape of the circulation stackers 9 constant.

The stepping motor slewing table 31 is configured with a pulse cycle field 32, a pulse number field 33, and a pulse index field 34.

A pulse cycle (μs) in the pulse cycle field 32 is intended to compare with a pulse cycle at a time point when an unequal interval mark as a timing mark is read with the tape sensor 29.

The number of pulses per second (pps) in the pulse number field 33 is intended to compare with the number of pulses per second at a time point when an equal interval mark as a timing mark is read with the tape sensor 29.

Associations between the pulse cycle (μs) in the pulse cycle field 32 and the number of pulses per second (pps) in the pulse number field 33, which are represented in association with the leftmost numbers 1 to 22, can be easily obtained from μs=10^−6·s.

The number of pulses per second is the number of pulses for originally driving the stepping motor (hereinafter referred to simply as a motor in some cases).

In this embodiment, as one example, pulse indexes 1, 2, 3, . . . , 10 and 11 are set as illustrated in the pulse index field 34, and the number of driving pulses 602, 633, 668, . . . , 1091 and 1199 are respectively assigned.

The above described pulse indexes respectively correspond to drum diameters of the winding drum 16. The pulse index 1 indicates an index when the drum diameter is close to a maximum diameter (a state where the capacity of wound bills is full and no more bills can be wound).

The pulse index 11 indicates an index when the drum diameter is close to a minimum diameter (an initial state where the capacity is empty with no wound bills).

The drum diameter of the winding drum 16 indicates not the diameter of the drum itself but the outer diameter of the tapes 17 that sandwich a bill and are wound as described above.

In other words, the drum diameter indicates the outer diameter of the roll shape (roll outer diameter) of the tapes 17 wound around the winding drum 16 in the state of sandwiching a bill, or in the initial state of not sandwiching a bill.

To keep the running velocity of the tapes 17, namely, the rotational linear velocity of the drum diameter of the winding drum 16 constant, it is necessary to make rotations of the winding drum 16 slowest if the drum diameter is close to the maximum, and fastest if the drum diameter is close to the minimum.

For example, the driving pulse velocity is made to be late (the number of pulses per second is reduced) by sequentially decrementing the setting of the pulse index from 11 to a smaller value with an increase in the drum diameter until the capacity is filled with bills after starting receiving (entering, winding) bills when the drum diameter is the minimum.

Additionally, for example, the driving pulse velocity is made to be fast (the number of pulses per second is increased) by sequentially incrementing the setting of the pulse index from "1" to a larger value with a decrease in the drum diameter until no more bills are left after starting dispensing (outputting, rewinding) bills when the drum diameter is the maximum.

Each of the associations between a pulse index and the number of pulses per second in the stepping motor slewing table 31 shown in FIG. 3 represents a relationship between a pulse index and the number of pulses per second for rotating the motor 30 as for a drum diameter (roll outer diameter) indicated by the pulse index so that the running velocity of the tape 17 is kept equal to the velocity before the drum diameter changes.

For this relationship, the number of rotations of the winding drum 16, which is obtained from the running amount of the tape 17 at a certain time point as a base point, is initially calculated, and the drum diameter (roll outer diameter) is calculated based on the calculated number of rotations of the winding drum 16, and the thicknesses of the tape 17 and a bill, which are obtained in advance.

Next, each of the associations is a relationship between a pulse index and the number of pulses per second for rotating the motor 30, which can make the tape 17 run at a velocity equal to that of a drum diameter before changing to the above calculated drum diameter and is empirically obtained, as for the calculated drum diameter.

In the meantime, if the running amount of the tape is indirectly calculated by using the encoder or the like attached to a rotational system for making the tape run, an accurate running amount of the tape cannot be obtained due to a slide or the like occurring between the rotational system and the tape as described above.

In this embodiment, the running amount of the tape 17 is directly obtained from the tape 17.

Figure 4:
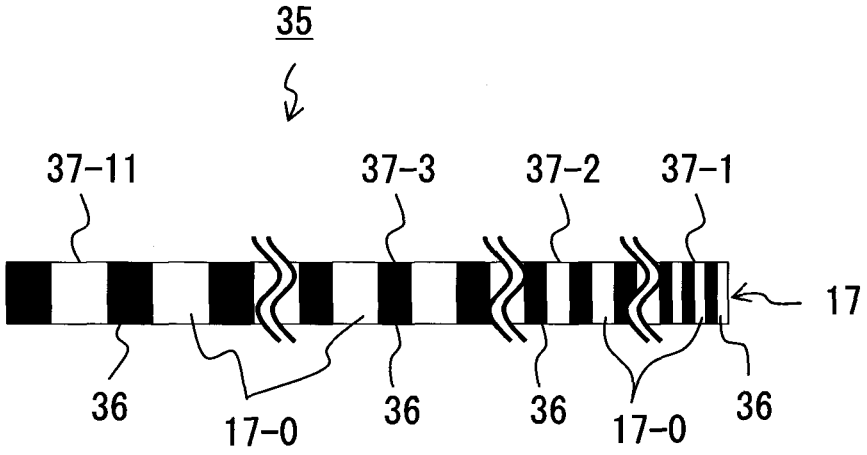
FIG. 4 illustrates unequal interval marks affixed on a surface of a tape in order to directly obtain, from the tape, the running amount of the tape in the circulation stacker according to the first embodiment.

FIG. 4 illustrates unequal interval marks affixed on either of the front and the back sides of the tape 17*b* in order to directly obtain the running amount of the tape 17 from the tape 17.

Timing marks 35 illustrated in FIG. 4 are printed in a color (such as black in this embodiment) different from the color (such as transparent or translucent in this embodiment) of blank parts 17-0 of the tape 17.

As the unequal interval marks 37 (37-1, 37-2, 37-3, . . . , 37-*n*) as the timing marks 35, the unequal interval marks 37-1 having the narrowest interval are printed at the start of the tape 17. The unequal interval marks 37-1 are printed by a predetermined length on the tape 17.

Next, the unequal interval marks 37-2 having a slightly wider interval than that of the unequal interval marks 37-1 are printed. The unequal interval marks 37-2 are printed by a predetermined length on the tape 17.

Then, the unequal interval marks 37-3 having a slightly wider interval than that of the unequal interval marks 37-2 are printed. The unequal interval marks 37-3 are printed by a predetermined length on the tape 17.

Similarly, unequal interval marks 37 having a slightly wider interval than that of preceding unequal interval marks 37 are repeatedly printed by a predetermined length up to the end of the tape 17.

Namely, an interval of unequal interval marks becomes narrower toward the start of the tape. In other words, a pulse cycle of detected marks becomes faster toward the start of the tape. Accordingly, a predetermined pulse number average time can be obtained in a relatively short time.

Originally, to make the tape run at a constant velocity on the start side of the tape, the motor 30 needs to be rotated fast, and to be accurately controlled to become a suitable number of rotations in a short time.

The reason why the intervals of unequal interval marks become narrower toward the start of the tape is to quickly control the motor 30 that rotates fast by obtaining an average time of a predetermined number of pulses in a short time and by comparing with the reference table of the number of pulses (or pulse cycles).

FIG. 5 illustrates a pulse table for deciding the driving pulse of the stepping motor 30 in order to control the running velocity of the tape 17 to be constant based on the above described unequal interval timing marks 35.

A velocity control table 40 illustrated in FIG. 5 is configured with the pulse table 41 composed of a pulse average time table on the left side, and a pulse index field 42 on the right side.

A print pitch field 34 and a winding diameter field 44 at the center are illustrated for reference.

Numeric values in the print pitch field 43 indicate intervals of the unequal interval marks 37 in units of mm. For example, 3 (mm) indicates an interval of the unequal interval marks 37-1 of FIG. 4, 6 (mm) indicates the unequal interval marks 37-2 of FIG. 4, and 33 (mm) indicates an interval of the unequal interval marks 37-11 of FIG. 4.

The winding diameter field 44 indicates a drum diameter (winding diameter (start, , , , . . . , end)) when the unequal interval marks 37-1 to 37-11 are detected by the tape sensor 29**.

The winding diameter is calculated based on the type and the thickness of a bill, and is not decided as a fixed value.

Indexes "11, 10, . . . , 3, 2, 1" in the pulse index field 42 are identical to those indicated in the pulse index field 34 of the stepping motor slewing table 31 of FIG. 3 although their order is reverse.

The velocity control table 40 is a table for obtaining a pulse index that indicates a driving pulse of the stepping motor 30 for rotating the winding drum 16 at an optimum drum diameter linear velocity when the unequal interval marks 37-1 to 37-11 are detected by the tape sensor 29.

The velocity control table 40 is created so that each of the pulse indexes directly corresponds to an average time of a predetermined number of pulses detected when the unequal interval marks 37-1 to 37-11 are detected by the tape sensor 29.

Accordingly, the velocity control table 40 does not originally need to represent a print pitch that generates detected pulses approximated to an average time of a predetermined number of detected pulses, and a winding diameter corresponding to the print pitch.

However, the print pitch field 43 and the winding diameter field 44 are additionally represented in the velocity control table 40 as a reference indicating that the pulse index is an index associated with the unequal interval marks 37 and the drum diameter (winding diameter) calculated from the unequal interval marks 37.

Note that the pulse index 1 indicates an index when the drum diameter is close to the maximum (the state where the capacity of wound bills is full and no more bills can be wound (winding end)), and the pulse index 11 indicates an index when the drum diameter is close to the minimum (the initial state where there are no wound bills (tape start) as described with reference to FIG. 3.

Figure 6:
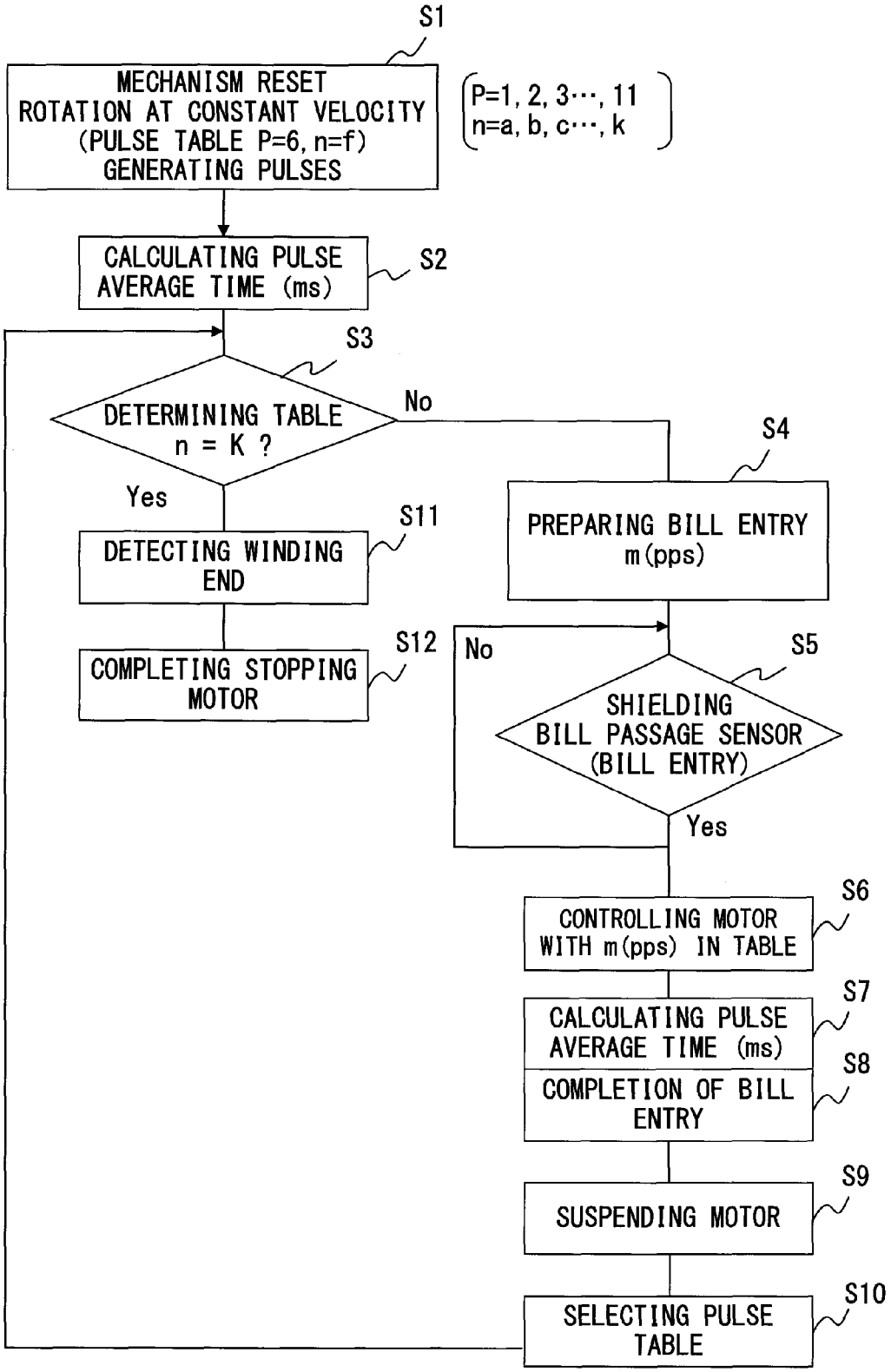
FIG. 6 is a flowchart illustrating a process for controlling the running velocity of the tape to be constant based on the unequal interval marks of the circulation stacker according to the first embodiment.

FIG. 6 is a flowchart illustrating a process for a rotation control of the stepping motor 30, which is executed by the controlling unit 2 in order to keep the tape velocity constant in the above described hardware configuration and data configuration.

In FIG. 6, the entire mechanism relationship is initially reset. Then, the motor 30 is driven at a rotational velocity set so that the tape velocity becomes a predetermined constant velocity with respect to the preceding stoppage position of the tape.

For example, pn is selected from the pulse table 41. Here, p=1, 2, 3, . . . , 11, and n=a, b, c, . . . , k are assumed. The index in the pulse index field 42 corresponding to the selected table numerical value pn is 6.

The number of pulses per second of the motor driving, which corresponds to the pulse index "6" that is equal to the index "6" in the pulse index field 42 and indicated by the stepping motor slewing table 31 (hereinafter referred to simply as the table 31) of FIG. 3, is 801 pps.

The controlling unit 2 makes the tape 17 run by driving the motor 30 with the number of pulses 801 (pps). Then, the unequal interval marks 37 of the tape 17 are read with the tape sensor 29 to generate pulses (step S1).

Next, the controlling unit 2 calculates a pulse average time (ms) by obtaining a predetermined number of successive pulses from the pulse cycles transmitted from the tape sensor 29 (step S2).

Then, the controlling unit 2 determines whether or not the pulse table value pn of the velocity control table 40, which corresponds to the calculated pulse average time, is n=k (step S3).

If n≠k ("NO" in the determination of step S3), the controlling unit 2 prepares a bill entry process by setting the driving pulse of the motor 30 to m (pps) in the table 31 (step S4).

With this process, the controlling unit 2 initially reads a pulse index in the pulse index field 42 corresponding to the pulse table value pn in the velocity control table 40, which corresponds to the above calculated pulse average time. Next, the controlling unit 2 reads the same pulse index as that from the table 31 of FIG. 3.

Then, the controlling unit 2 reads, from the pulse number field 33, the number of pulses per second "m (pps)" corresponding to the read pulse index, and sets the read number of pulses per second "m (pps)" as the driving pulse of the motor 30 "m (pps)".

Next, the controlling unit 2 determines whether or not a bill entry notification generated by shielding of the optical path of the bill passage detection sensor 24 has been made (step S5). If the bill entry notification has not been made ("NO" in the determination of step S5), the controlling unit 2 waits until the notification is made.

If the bill entry notification has been made ("YES" in the determination of step S5), the controlling unit 2 executes a bill entry process by controlling the driving of the motor 30 with the above set driving pulse "m (pps)" in the table 31 (step S6).

The controlling unit 2 calculates an average time (ms) of a predetermined number of pulses obtained by reading the unequal interval marks 37 of the tape 17 with the tape sensor 29 while the tape 17 is being wound in the bill entry process (step S7).

Upon completion of the bill entry process for one bill (step S8), the controlling unit 2 suspends the motor 30 (step S9).

Then, the controlling unit 2 selects a pulse table value to be used thereafter from the calculated pulse average time (ms) while the tape 17 is being wound in the bill entry process (step S10).

Assume that a first cycle of the sequence process is currently being executed in this process. Also assume that the pulse table value pn initially set in the velocity control table 40 is "6f".

Further assume that the pulse average time (ms) calculated while the tape 17 is being wound in the bill entry process indicates "6g".

Currently, the bill entry process is being executed and the tapes 17 are being wound while sandwiching a bill. Therefore, the drum diameter of the winding drum 16 is gradually increasing.

Namely, the rotations of the winding drum 16 need to be gradually slowed down in order to keep the running velocity of the tape 17 constant.

Therefore, the controlling unit 2 sets the number of pulses per second "m (pps)" (driving pulses) corresponding to the pulse index "5" in the table 31, and selects "5n" in the pulse table 41.

Next, the flow goes back to step S3, in which the controlling unit 2 again determines whether or not the pulse average time (ms) calculated in step S7 is "n=k" in "5n" in the pulse table 41.

If n≠k ("NO" in the determination of step S3), steps S4 to S3 are repeated, and the bill entry process proceeds. Accordingly, the drum diameter of the winding drum 16 is gradually increasing.

With selections of the pulse table 41, the pulse index gradually decrements from 4n, to 3n, to 2n, and the running velocity of the tape 17 is gradually slowing down.

If n=k is determined in the determination of step S3, the controlling unit 2 makes a suitable display device display the winding end (step S11), and completely stops the motor 30 (step S12).

Also with the dispensing process, the pulse table 6n is similarly selected at a base time point of the process although this is not particularly illustrated. The motor driving pulse is a driving pulse set at the preceding suspension.

In the dispensing process, the drum diameter of the winding drum 16 gradually decreases. Namely, the rotations of the winding drum 16 need to be gradually sped up in order to keep the running velocity of the tapes 17 constant.

Then, in the determination of step S3, whether or not n=a is determined. If n=a, this means that the start of the tape 17 is close (no received bills are left). Therefore, the controlling unit 2 makes the suitable display device display the start of the tape 17 in step S11. Then, in step S12, the controlling unit 2 completely stops the motor 30.

Second Embodiment

Figure 7:
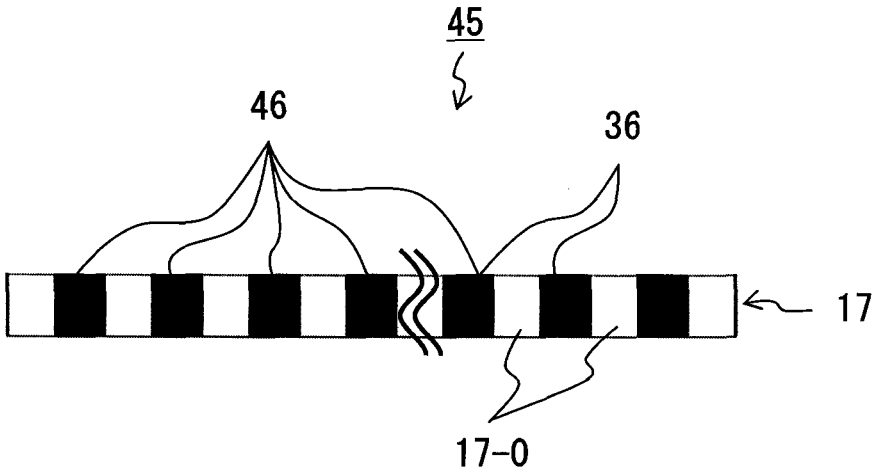
FIG. 7 illustrates equal interval marks affixed to a surface of the tape in order to directly obtain, from the tape, the running amount of the tape of a circulation stacker according to a second embodiment.

FIG. 7 illustrates equal interval timing marks affixed on either of the front and the back sides of the tape 17 in order to directly obtain, from the tape 17, the amount of running of the tape 17 in the circulation stackers 9 according to the second embodiment.

Equal interval marks 46 as timing marks 45 illustrated in FIG. 7 are printed in a color 36 (such as black in this embodiment) different from a color (such as transparent or opaque in this embodiment) of blank parts 17-0 of the tape 16.

These equal interval marks 46 are printed successively at equal intervals from the start to the end of the tape 17.

Accordingly, by counting the number of equal interval marks, namely, the number of detected pulses transmitted from the bill passage detection sensor 24 at each read of each of the marks, the running length of the tape 17 can be easily obtained.

Moreover, the drum diameter used as a base of the process executed this time is stored at the termination of the preceding process. Therefore, if the running length (the number of detected pulses) of the tape 17 is obtained with the process executed this time, the number of rotations of the winding drum 16 can be calculated both in forward and backward directions.

If the number of rotations of the winding drum 16 is obtained, the drum diameter can be calculated based on the thickness of the tape 17 and that of a bill.

The minimum (Y mm, the start of the tape) and the maximum (X mm, the winding end) of the drum diameter are learned in advance, and stored in a storage device or the like within the controlling unit 2.

Also in this embodiment, the number of pulses per second set in association with the indexes "1", "2", "3", . . . , "11" in the pulse index field 34 of the table 31 illustrated in FIG. 3 is associated with each drum diameter.

In this association, assuming that the number of bills storable in one circulation stacker 9 is 100, the above described index increments or decrements by 1 each time every 10 bills are wound (entered) or rewound (dispensed).

Namely, a tolerance corresponding to 10 bills is set for a change of the drum diameter and a change of the running velocity of the tape 17.

Here, assume that the drum diameter D takes the amount of a change, including the above described tolerance of n1 (mm), n2 (mm), n3 (mm), nd (mm) (d=4, 5, 6, . . . , 10) every 10 bills.

Figure 8A:
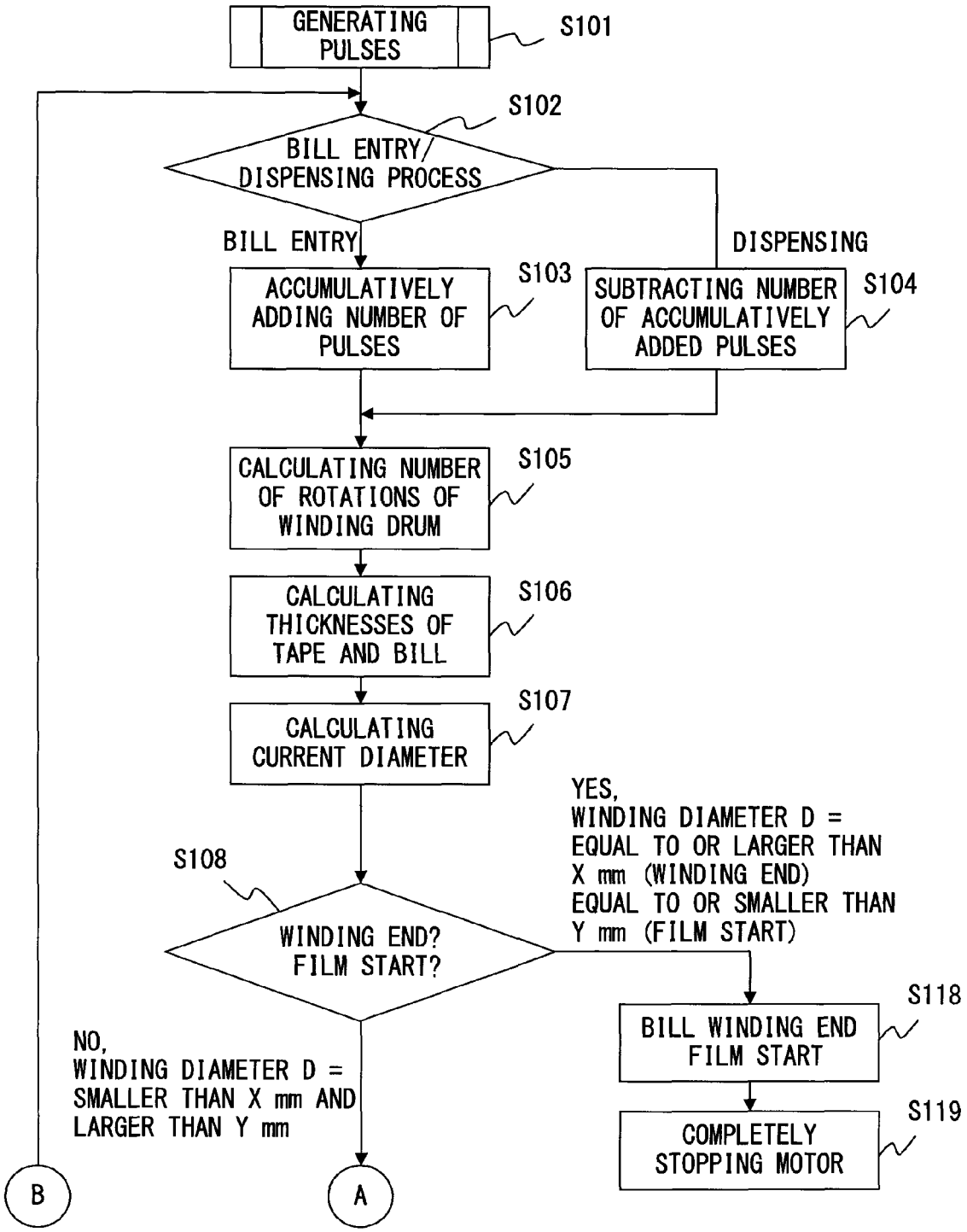
FIGS. 8A and 8B are flowcharts of a process for controlling the running velocity of the tape to be constant based on the equal interval marks in the circulation stacker according to the second embodiment.
Figure 8B:
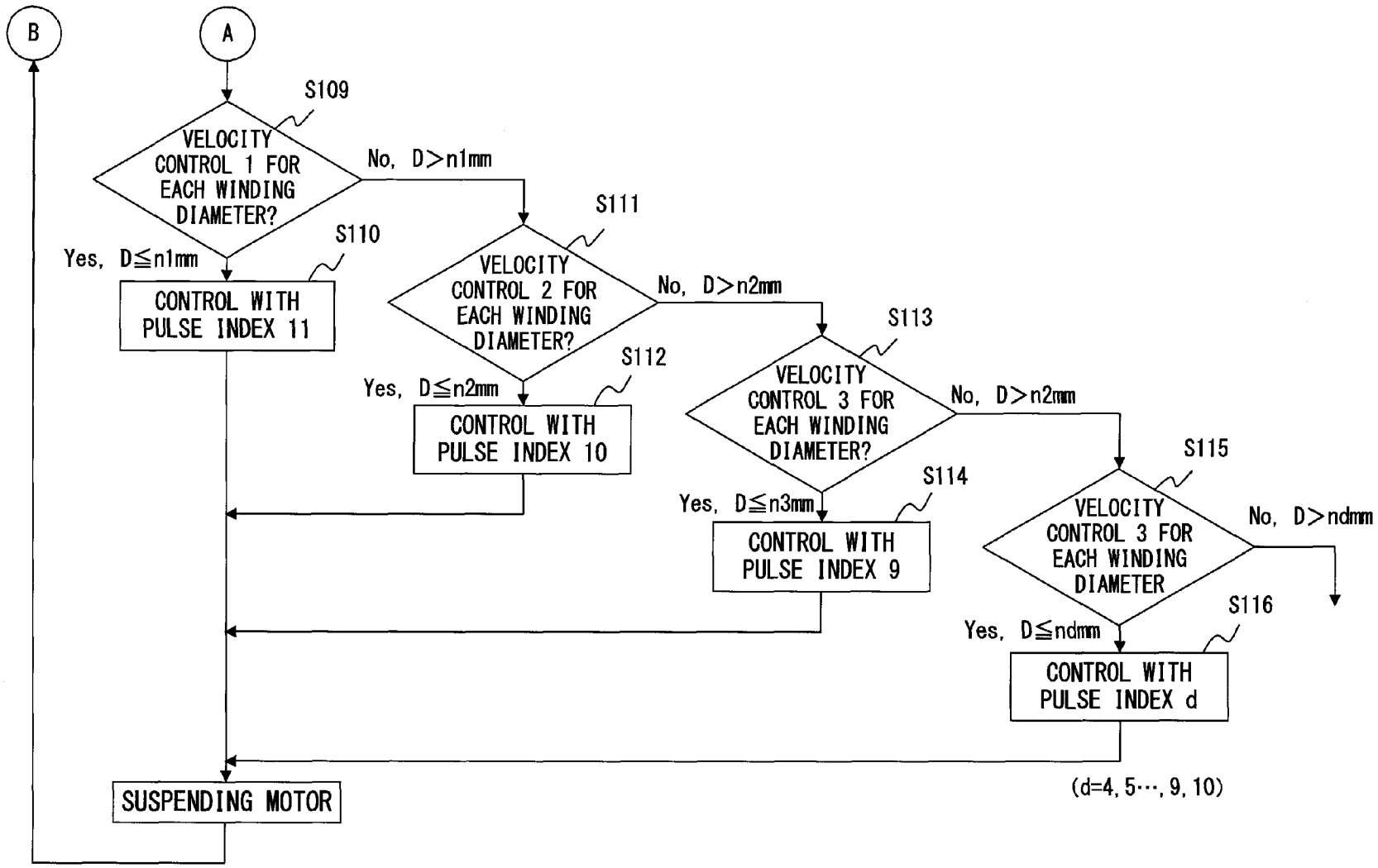

FIG. 8 is a flowchart illustrating a process for controlling the running velocity of the tape 17 to be constant for the circulation stackers 9 for entering/dispensing a bill with the use of the tape 17 affixed with the above described equal interval marks 45.

The controlling unit 2 initially makes the tapes 17 run by driving the motor 30, and generates detection pulses with the equal interval marks 45 (step S101).

Then, the controlling unit 2 determines whether the current process is either a bill entry process or a dispensing process (step S102).

Here, only the bill entry process is described below to simplify the flow of the process. Namely, if determining that the current process is the bill entry process in step S102, the controlling unit 2 accumulatively adds the number of detected pulses (step S103).

Next, the controlling unit 2 calculates the number of rotations of the winding drum 16 from the number of detected pulses that have been accumulatively added (step S105).

Additionally, the controlling unit 2 calculates the thickness of the tape 17 and that of an entered bill (step S106).

Then, the controlling unit 2 calculates the current diameter, namely, the current drum diameter D from the above calculated number of rotations of the winding drum 16 and the calculated thicknesses of the tape 17 and the entered bill (step S107).

Then, the controlling unit 2 determines whether or not a bill receipt amount of the circulation stacker 9 reaches the winding end (step S108).

This process is a process for determining whether or not the calculated drum diameter D is equal to or larger than the maximum diameter X mm by comparing the above calculated drum diameter D with the maximum diameter X mm of the drum diameter, which is stored in the storage device and learned in advance.

In the meantime, in the determination of step S108, whether or not the winding end has been reached, and whether or not the film start has been reached (the start of the tape 17. The same applies hereinafter) are simultaneously determined.

Here, the determination of whether or not the winding end has been reached is the determination made for the bill entry process, and the determination of whether or not the film start has been reached is the determination made for the dispensing process.

If the bill receipt amount has not reached the winding end yet in the determination of step S108 ("NO" in step S108), the controlling unit 2 then determines whether or not to perform a velocity control 1 for each winding diameter (step S109).

With this process, whether or not to perform the control is determined depending on whether or not the drum diameter D is equal to or smaller than n1 (mm).

If the drum diameter D is equal to or smaller than n1 (mm) ("YES" in the determination of step S109), the number of received bills is smaller than 10. Namely, the 10 bills have not been wound yet from the tape start.

In this case, the controlling unit 2 controls the driving of the motor 30 with the number of pulses 1199 (see FIG. 3. The same applies hereinafter) corresponding to the running velocity of the tape at the start of the tape, which is set in association with the pulse index 11, and receives a bill (step S110).

Then, the controlling unit 2 suspends the motor 30 (step S117), and the flow goes back to step S102. Then, steps S102, S103, S105 to S112, S117 and S102 are repeated.

Thereafter, if the 10 bills have been wound, the drum diameter D becomes larger than n1 (mm) in the determination of step S109 ("NO" in the determination of step S109).

In this case, the controlling unit 2 determines whether or not to perform a velocity control 2 for each winding diameter (step S111).

With this process, whether or not to perform the velocity control is determined depending on whether or not the drum diameter D is equal to or smaller than n2 (mm). If the drum diameter D is equal to or smaller than n2 (mm) ("YES" in the determination of S111), the number of received bills is smaller than 20.

In this case, the controlling unit 2 controls the driving of the motor 30 with the number of pulses per second "1091" corresponding to the tape running velocity set in association with the pulse index "10" slower than that at the tape start, and receives a bill (step S112).

Then, the controlling unit 2 suspends the motor 30 (step S117), and the flow goes back to step S102. Then, steps S102, S103, S105 to S112, S117 and S102 are repeated.

If the 20 bills have been received in total, the drum diameter D becomes larger than n2 (mm) in the determination of step S111 ("NO" in the determination of S111).

Next, the controlling unit 2 determines whether or not to perform a velocity control 3 for each winding diameter (step S113).

Hereafter, the controlling unit 2 similarly determines whether or not to perform a velocity control d (d=4, 5, . . . 9, 10) for each winding diameter if the drum diameter D becomes larger than n3 (mm). If the drum diameter D is equal to or smaller than nd, the controlling unit 2 receives a bill by controlling the driving of the motor 30 with the number of pulses per second corresponding to the tape running velocity set in association with the pulse index "d".

Then, if the drum diameter D becomes larger than nd, the controlling unit 2 sets the drum diameter D to d=d+1, and repeats the above described processes with respect to the new d.

Thereafter, in the determination of step S108, the winding diameter D, namely, the drum diameter D becomes larger than X mm ("YES" in the determination of step S108).

In this case, the controlling unit 2 makes the suitable display device display the winding end of the bill (step S118), completely stops the motor 30 (step S119), and terminates the process.

For example, if the dispensing process is executed in the winding end state of a bill, the flow goes from step S102 to step S104, and further from steps S105 to S109, S111, S113, and S115 although detailed explanations are omitted. Hereafter, the determinations proceed until the drum diameter D becomes n10.

Then, the drum diameter D≤n10 is determined, and one bill is rewound (dispensed), and the flow goes back to step S102 via step S117.

Thereafter, each time a bill is dispensed, the determination of step S115, the determination of step S113, the determination of step S111, and the determination of step S109 sequentially result in "YES", and the last bill is dispensed.

Then, the flow goes to steps S117, S102, S104 and S105 to S108, and the determination of the film start results in "YES". Then, the controlling unit 2 makes the suitable display device display the film start (step S118), and completely stops the motor 30 (step S119). Here, the process is terminated.

Figure 9:
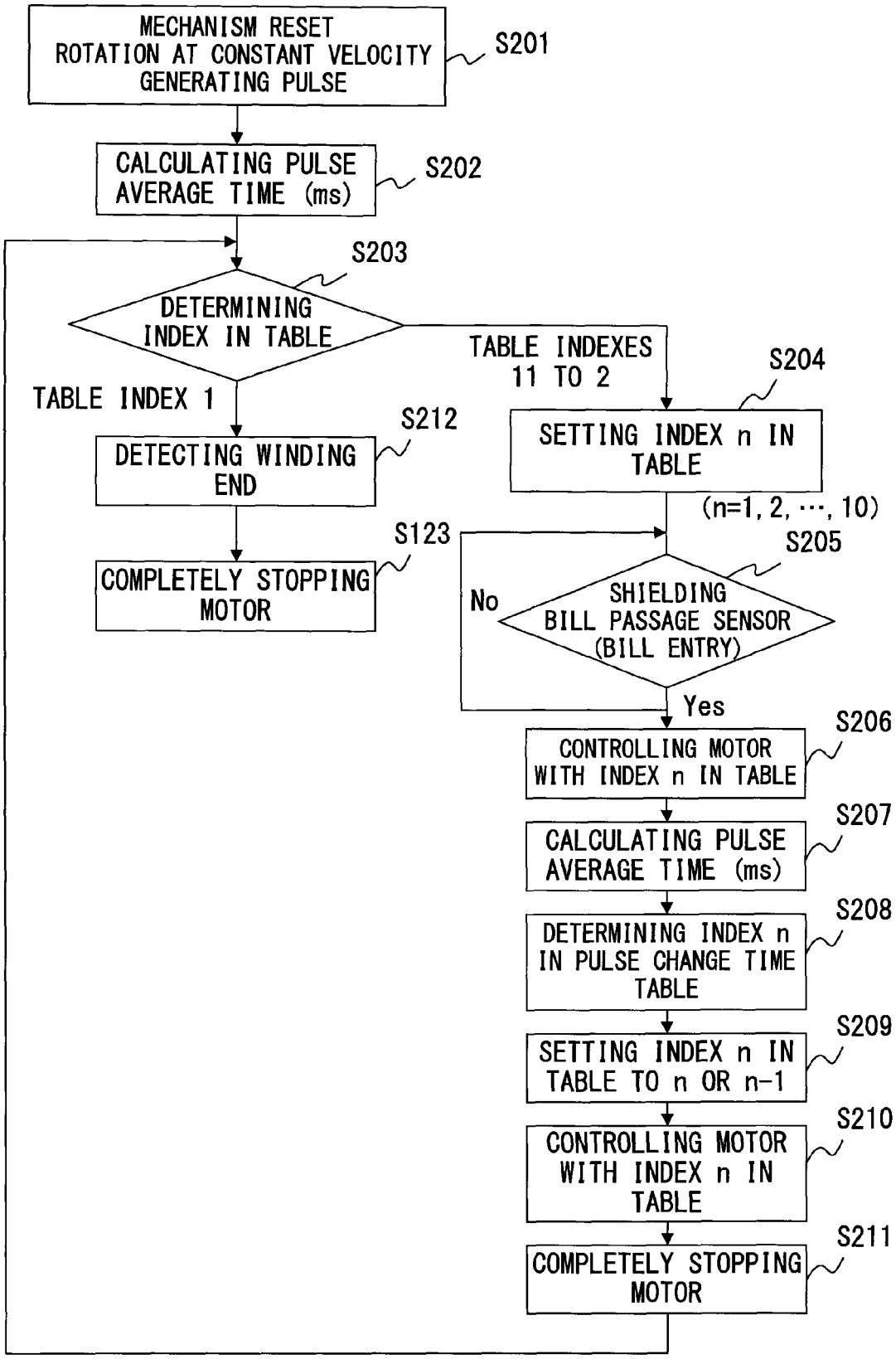
FIG. 9 is a flowchart illustrating another example of the process for controlling the running velocity of the tape to be constant based on the equal interval marks in the circulation stacker according to the second embodiment.

FIG. 9 is a flowchart illustrating another example of the process for controlling the running amount of the tape 17 to be constant based on the equal interval marks 45 of the circulation stacker 9 according to the second embodiment.

Also in this embodiment, the table 31 illustrated in FIG. 3 is used. Assume that the pulse indexes 1, 2, 3, . . . , 10, 11 in the pulse index field 34 are represented as a algebra n.

Also assume that the number of bills storable in one circulation stacker 9 is 100 and the above described index n decrements by 1 each time every 10 bills are wound (entered).

Additionally, a pulse table that makes an association between a pulse average time (ms) obtained by counting pulses and the pulse index n in the table 31 is prepared in this embodiment although the table is not particularly illustrated.

In FIG. 9, the controlling unit 2 initially resets the entire mechanism relationship. Then, the controlling unit 2 drives the motor 30 at a rotational velocity set so that the tape velocity becomes a predetermined constant velocity with respect to the preceding stoppage position of the tape.

Then, the controlling unit 2 obtains pulses generated by the scanning of the equal interval marks 45 of the running tape 17 by the tape sensor 29 (step S201), and calculates a pulse average time (ms) from the obtained predetermined number of pulses (step S202).

Next, the controlling unit 2 determines the index in the table (step S203).

This process is a process for determining that which of the pulse indexes 1, 2, 3, . . . , 10, 11 is the pulse index n obtained from the above described pulse table corresponds to in association with the above calculated pulse average time (ms).

If n≠1, the flow goes to step S204, in which the controlling unit 2 temporarily stores (sets) the determined pulse index n in a memory within the controlling unit 2 (step S204).

Then, the controlling unit 2 determines whether or not the bill passage detection sensor 24 has detected the passage of a bill (the entered bill has shielded the optical path of the sensor) (step S205).

If the bill passage detection sensor 24 has not detected the passage of a bill ("NO" in the determination of step S205), the controlling unit 2 waits until the bill passage detection sensor 24 detects the passage of a bill. If the bill passage detection sensor 24 has detected the passage of a bill ("YES" in the determination of step S205), the controlling unit 2 reads the number of pulses per second corresponding to the pulse index n set in the memory from the pulse number field 33 of the table 31.

The controlling unit 2 drives the motor 30 with the read number of pulses per second (step S206).

Then, the controlling unit 2 calculates a pulse average time (ms) from the predetermined number of pulses obtained from the equal interval marks 45 of the tape 16 that is made to run by the driving of the motor 30, and pulses generated by the tape sensor 29 (step S207).

Next, the controlling unit 2 determines the index in the table by determining whether or not the calculated pulse average time has changed in comparison with the pulse average time obtained in step S202 (step S208).

Based on this determination, the controlling unit 2 sets the pulse index n to n if the pulse average time has not changed.

This is because the pulse average time is within the duration of winding every 10 bills.

Alternatively, if the pulse average time has changed, the controlling unit 2 sets the pulse index n to n−1. This is because the pulse average time exceeds the duration of winding every 10 bills (step S209).

Then, the controlling unit 2 reads the number of pulses per second corresponding to the set pulse index n from the pulse number field 33 of the table 31, and drives the motor 30 with the read number of pulses per second (step S210).

When one bill is entered (received) as described above, the controlling unit 2 suspends the motor 30 (step S211). Then, the flow goes back to step S203.

Next, the controlling unit 2 repeats steps S204 to S211 and S203 if n≠1 in the determination of step S203.

Alternatively, if n=1 in the determination of step S203, the controlling unit 2 makes the suitable display device display the detection of the winding end (step S212), and completely stops the motor 30 (step S213).

In the dispensing process, steps 201 and 202 are identical to those of the bill entry process although they are not particularly illustrated.

In step S203, whether or not n≠11 is determined. If n≠11, a pulse index n within the range from 1 to 10 is set in and after step S204. In step S205, the bill passage detection sensor 24 detects the passage of a bill.

In step S209, if the pulse average time has not changed, n is set to n. This is because the pulse average time is within the duration of winding every 10 bills. If the pulse average time has changed, n is set to n+1. This is because the pulse average time exceeds the duration of winding every 10 bills.

If n=11 is determined in step S203, the display device or the like is made to display the tape start (winding end) in step S212. Processes in the other steps are identical to those of the bill entry process.

With the above described processes using the unequal interval marks or equal interval marks as timing marks, a constant tape velocity, and the start and the end (winding end) of a tape are detected only by detecting the timing marks.

However, a tape start mark and a tape end mark may be added and used to detect the start and the end (winding end) of a tape without limiting to the timing marks.

Figure 10:
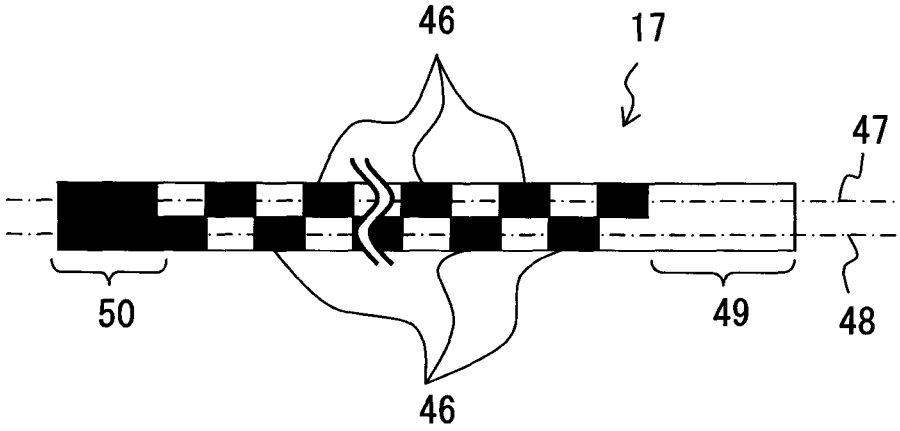
FIG. 10 illustrates an example where a tape start mark and a tape end mark are added to equal interval timing marks in a circulation stacker according to a third embodiment.

FIG. 10 illustrates an example where the tape start mark and the tape end mark are further added to equal interval marks as timing marks in a circulation stacker according to a third embodiment.

Two tape sensors 29 are used for the circulation stacker according to this embodiment although they are not particularly illustrated.

As illustrated in FIG. 10, equal interval marks 46 as timing marks are printed by being staggered on the tape 17 in this embodiment respectively for an optical path 47 of a first tape sensor 29 and an optical path 48 of a second tape sensor 29.

Additionally, the start (or the end) 49 of the tape 17 is blank with no printed equal interval marks 46.

Furthermore, the end (or the start) 50 of the tape 17 is solid-printed in the same color as that of the equal interval marks 46.

The start (or the end) 49 and the end (or the start) 50 are provided in a range longer than an interval of the equal interval marks 46.

Accordingly, the start (or the end) 49 or the end (or the start) 50 can be immediately detected if a duration during which pulses of the equal interval marks 46 are low or a duration during which pulses are high is longer than the pulses of the equal interval marks 46.

What is claimed is:

1. A paper sheet receiving/dispensing apparatus of a strip film type for receiving a paper sheet by sandwiching the paper sheet between two strip films respectively held by two holding rollers, and by winding the paper sheet around a winding drum along with the strip films, and for dispensing the paper sheet by rewinding the strip films wound around the winding drum, comprising:

a stepping motor for driving rotations of the holding rollers and the winding drum in forward and backward directions;

the two strip films leaders of which are affixed on a winding shaft, on at least one of front and back sides, with marks at intervals of a predetermined pattern in a predetermined shape and in a color different from a color of the strip films;

a detection sensor for detecting the marks;

a storage device for storing a stepping motor slewing table that indicates an association between an index corresponding to a roll outer diameter of the strip films wound around the winding drum and the number of driving pulses or a pulse cycle of the stepping motor, which is specified by the index; and a controlling unit, wherein the controlling unit comprises pulse signal obtaining unit obtaining a pulse signal indicating that the marks have been detected by the detection sensor during running of the strip films, drum rotation number calculating unit calculating the number of rotations of the winding drum based on the number of pulses of the pulse signal obtained by the pulse signal obtaining unit, roll outer diameter calculating unit calculating the roll outer diameter based on the number of rotations of the winding drum, which is calculated by the drum rotation number calculating unit, and thicknesses of the strip films and the paper sheet, which are obtained in advance, driving pulse setting unit setting the number of driving pulses for the stepping motor based on the roll outer diameter calculated by the roll outer diameter calculating unit, and the stepping motor/slewing table stored in the storage device, and velocity controlling unit controlling a running velocity of the strip films to be a predetermined constant velocity by applying, to the stepping motor, the number of driving pulses set by the driving pulse setting unit.

2. The paper sheet receiving/dispensing apparatus according to claim 1, wherein the intervals of the predetermined pattern are unequal intervals that sequentially become wider or narrower based on a predetermined rule.

3. The paper sheet receiving/dispensing apparatus according to claim 1, wherein the intervals of the predetermined pattern are constantly equal intervals.

4. The paper sheet receiving/dispensing apparatus according to claim 1, wherein if the roll outer diameter is smaller, the number of driving pulses is set to a larger number per second, or the pulse cycle is set to a narrower width, and if the roll outer diameter is larger, the number of driving pulses is set to a smaller number per second, or the pulse cycle is set to a wider width.

* * * * *